US009403628B2

(12) United States Patent
Keane et al.

(10) Patent No.: US 9,403,628 B2
(45) Date of Patent: Aug. 2, 2016

(54) VENTED BEVERAGE CAN AND CAN END

(71) Applicant: Crown Packaging Technology, Inc., Alsip, IL (US)

(72) Inventors: Brendan Keane, Deerfield, IL (US); Brian Fields, Lemont, IL (US); Vivek Doshi, Chicago, IL (US)

(73) Assignee: Crown Packaging Technology, Inc., Alsip, IL (US)

( * ) Notice: Subject to any disclaimer, the term of this patent is extended or adjusted under 35 U.S.C. 154(b) by 0 days.

(21) Appl. No.: 14/075,622

(22) Filed: Nov. 8, 2013

(65) Prior Publication Data

US 2014/0263333 A1 Sep. 18, 2014

Related U.S. Application Data

(60) Provisional application No. 61/782,316, filed on Mar. 14, 2013.

(51) Int. Cl.
*B65D 51/16* (2006.01)
*B65D 17/00* (2006.01)

(52) U.S. Cl.
CPC ..... *B65D 51/1683* (2013.01); *B65D 17/165* (2013.01); *B65D 51/1672* (2013.01); *B65D 2517/0014* (2013.01); *B65D 2517/0062* (2013.01); *B65D 2517/0082* (2013.01); *B65D 2517/0094* (2013.01)

(58) Field of Classification Search
CPC ..... B65D 51/00; B65D 2517/0094; B65D 2205/00; B65D 7/04; B65D 7/045; B65D 17/165; B65D 2517/0092; B65D 51/1683; B65D 51/1672; B65D 251/0094; B67B 7/00
USPC ..... 220/269, 271, 906, 367.1; 413/12, 413/14–16
See application file for complete search history.

(56) References Cited

U.S. PATENT DOCUMENTS

| | | | |
|---|---|---|---|
| 3,215,305 | A | 11/1965 | Frankenberg |
| 3,441,169 | A | 4/1969 | Dunn et al. |
| 3,741,432 | A | 6/1973 | Werth et al. |
| 3,782,586 | A | 1/1974 | Brown |
| 3,795,340 | A | 3/1974 | Hougen et al. |
| 3,838,788 | A | 10/1974 | Stargell |
| 3,869,063 | A | 3/1975 | Himstedt |
| 3,964,632 | A | 6/1976 | Bozek |
| 3,967,754 | A | 7/1976 | Ostrem |
| 4,014,455 | A | 3/1977 | LaCroce |
| 4,134,517 | A | 1/1979 | Rhoades |
| 4,136,797 | A | 1/1979 | Potts |
| 4,367,996 | A | 1/1983 | Saunders |
| 5,011,037 | A | 4/1991 | Moen et al. |
| D322,222 | S | 12/1991 | Coy |
| 5,131,555 | A | 7/1992 | DeMars et al. |
| 5,224,618 | A | 7/1993 | Garbiso |

(Continued)

FOREIGN PATENT DOCUMENTS

| | | |
|---|---|---|
| CA | 2280461 | 2/2001 |
| CN | 302188734 | 4/2012 |

(Continued)

*Primary Examiner* — Fenn Mathew
*Assistant Examiner* — James N Smalley
(74) *Attorney, Agent, or Firm* — Baker & Hostetler LLP

(57) ABSTRACT

A beverage can end has a vent that includes a button. The vent is actuated by downward force of a pull tab that is transmitted to the vent score through the button.

18 Claims, 12 Drawing Sheets

(56) References Cited

U.S. PATENT DOCUMENTS

| | | | | |
|---|---|---|---|---|
| 5,285,919 | A | 2/1994 | Recchia | |
| 5,307,947 | A | 5/1994 | Moen et al. | |
| 5,375,729 | A | 12/1994 | Schubert | |
| 5,397,014 | A | 3/1995 | Aydt | |
| 5,494,184 | A * | 2/1996 | Noguchi et al. | 220/269 |
| 5,555,992 | A | 9/1996 | Sedgeley | |
| 5,653,355 | A * | 8/1997 | Tominaga et al. | 220/269 |
| 5,692,636 | A | 12/1997 | Schubert | |
| 5,695,085 | A | 12/1997 | Hadener | |
| 5,860,553 | A | 1/1999 | Schubert | |
| 6,015,060 | A | 1/2000 | Rightenour et al. | |
| 6,079,583 | A | 6/2000 | Chasteen | |
| D437,223 | S | 2/2001 | Coy et al. | |
| 6,234,338 | B1 | 5/2001 | Searle | |
| 6,354,453 | B1 | 3/2002 | Chasteen | |
| 6,494,332 | B1 | 12/2002 | Haughton et al. | |
| 6,715,629 | B2 | 4/2004 | Hartman et al. | |
| 6,763,964 | B1 | 7/2004 | Hurlbut et al. | |
| 6,951,293 | B2 | 10/2005 | Thibaut | |
| 7,000,797 | B2 | 2/2006 | Forrest et al. | |
| 7,513,383 | B2 | 4/2009 | Hwang | |
| 7,748,563 | B2 | 7/2010 | Turner et al. | |
| 7,942,285 | B2 | 5/2011 | Hasegawa et al. | |
| 7,975,884 | B2 | 7/2011 | Mathabel et al. | |
| 8,011,527 | B2 | 9/2011 | Forrest et al. | |
| 8,186,532 | B2 | 5/2012 | Shinguryo et al. | |
| 8,196,767 | B2 | 6/2012 | Fields | |
| 8,678,221 | B2 | 3/2014 | Thiemann et al. | |
| 2003/0038134 | A1 | 2/2003 | Chasteen et al. | |
| 2003/0075544 | A1 | 4/2003 | Turner et al. | |
| 2004/0056032 | A1 | 3/2004 | Vaughan | |
| 2004/0140314 | A1 | 7/2004 | Li | |
| 2004/0144787 | A1 | 7/2004 | Heck | |
| 2004/0159665 | A1 | 8/2004 | Morrissey et al. | |
| 2004/0211786 | A1 | 10/2004 | Turner et al. | |
| 2006/0016815 | A1 | 1/2006 | Rieck et al. | |
| 2007/0029334 | A1 | 2/2007 | Bagley | |
| 2007/0051727 | A1 | 3/2007 | Holley | |
| 2007/0215621 | A1 | 9/2007 | Shinguryo et al. | |
| 2009/0001081 | A1 | 1/2009 | Schlattl et al. | |
| 2009/0039090 | A1 | 2/2009 | Forrest et al. | |
| 2009/0039091 | A1 | 2/2009 | Forrest et al. | |
| 2009/0065518 | A1 | 3/2009 | Carnevali | |
| 2009/0090716 | A1 | 4/2009 | Stengel, Jr. | |
| 2009/0206083 | A1 | 8/2009 | Heigl | |
| 2010/0018976 | A1 | 1/2010 | Christian et al. | |
| 2010/0219187 | A1 | 9/2010 | Na | |
| 2010/0294771 | A1 | 11/2010 | Holder et al. | |
| 2011/0056946 | A1 | 3/2011 | Emanuele, III et al. | |
| 2011/0108552 | A1 | 5/2011 | Tamarit Rios | |
| 2011/0266281 | A1 | 11/2011 | Thiemann et al. | |
| 2012/0199587 | A1 | 8/2012 | Norris | |
| 2012/0205378 | A1 | 8/2012 | Forrest | |
| 2013/0037543 | A1 | 2/2013 | McClung et al. | |
| 2013/0075401 | A1 | 3/2013 | Forrest | |
| 2013/0118133 | A1 * | 5/2013 | Jacober et al. | 53/492 |
| 2013/0270269 | A1 | 10/2013 | Forrest | |
| 2014/0054290 | A1 | 2/2014 | McClung et al. | |

FOREIGN PATENT DOCUMENTS

| | | |
|---|---|---|
| EP | 2113293 | 11/2009 |
| EP | 2601109 | 6/2013 |
| GB | 2320008 | 6/1998 |
| JP | 60150922 | 10/1985 |
| JP | 05-178345 | 7/1993 |
| JP | 5504318 | 7/1993 |
| JP | 05-310248 | 11/1993 |
| JP | H1035662 | 2/1998 |
| JP | 11348979 | 12/1999 |
| JP | 2000-185757 | 7/2000 |
| JP | 2001-018960 | 1/2001 |
| JP | 2003-285837 | 10/2003 |
| JP | 2004-042982 | 2/2004 |
| JP | 2005-343557 | 12/2005 |
| JP | 2006-160303 | 6/2006 |
| JP | 2006-347580 | 12/2006 |
| JP | 2007-320617 | 12/2007 |
| WO | WO 93/25445 | 12/1993 |
| WO | WO 2008/023983 | 2/2008 |
| WO | WO 2012/018549 | 2/2012 |
| WO | WO 2013/067398 A2 | 5/2013 |

* cited by examiner

VENTED BEVERAGE CAN AND CAN END

CROSS-REFERENCE TO RELATED APPLICATIONS

This claims the benefit of U.S. Patent Application Ser. No. 61/782,316 filed Mar. 14, 2013, the disclosure of which is hereby incorporated by reference as if set forth in its entirety herein.

BACKGROUND

The present invention relates to containers, and more particularly to beverage containers having a vent for releasing internal pressure and/or for enhancing pouring.

Modern beverage can ends include a rivet formed on a center panel, a tab coupled to the end by a rivet, and a score that is ruptured to form a pour opening. The ends are required to have very low failure rates even while being produced in vast quantities and rated to contain 85 psi or greater. Several vented beverage ends have been disclosed over many years. A vented beverage end may be used on a container that is not required to be pressurized, such as container for non-carbonated beverages.

U.S. Pat. Nos. 6,079,583 and 6,354,453 disclose an end having venting capabilities that does not require a second opening. United States Patent Publication Number 2001/0266281 discloses an end having a vent score that is spaced apart from the main score. The vent score defines a vent tear panel that is raised. The vent score is ruptured by first positioning a concave region of the tab on the raised vent tear panel and pushing downward on the tab to rupture the vent score.

There is a need for improved reliability and functionality of vent openings in commercial quantities.

SUMMARY

A can end has vent features that provide improved function. This summary provides an overview of the features of the end, and it is understood that several features can work together to enhance performance of the end and its vent. Accordingly, the present invention is not limited to the particular features in the combinations provided below. Further, no particular feature or dimension is required unless expressly set out in the claims.

A beverage can end can end for containing a pressurized beverage includes: a peripheral curl capable of being joined to a can body by seaming; a wall structure radially inward from the curl; a center panel; a main score defining a main hinge and a main tear panel that is capable of opening upon rupture of the score to form a pour opening; a tab coupled to the center panel by a rivet, the tab having a nose capable of contacting a portion of the main tear panel for rupturing the main score, a body, and a heel formed opposite the nose, the heel being configured for grasping by a user; and a vent. The vent includes an elongated vent score defining a vent tear panel and a vent hinge located approximately between opposing ends of the vent score. An upwardly protruding button is located on the vent tear panel. A vent recess is formed in the center panel, and the vent tear panel is located in the vent panel recess. The structure is such that actuation of the tab by lifting the heel is capable of rupturing the main score, actuation of the tab by pressing down on the tab is capable of rupturing the vent score, and the elongated vent score provides enhanced venting capacity upon deflection of the vent tear panel after rupture. The vent is spaced apart from the main score and pour opening.

And the center panel optionally comprises a main recess, such that each one of main score, rivet, and vent panel recess being formed in the main recess and a periphery of the vent panel recess is tangential to a periphery of the main recess. Further the vent button is located outboard of the tab while the tab is positioned to actuate the main score and the vent panel recess is located proximate a peripheral edge of the center panel distal from the rivet, whereby the vent is located to enhance venting. The tab may include an elongated bead on an underside of the tab proximate the heel, and the tab and vent score may be configured such that after actuation of the tab bead against the vent button, the tab bead is configured to enter into opening created upon rupture of the vent score to enhance deflection of the vent tear panel about the vent hinge.

Preferably, the vent score, at a point at which the vent score is closest to a sidewall of the button, is located on the button or has a distance D3 or D13 from the button sidewall of no more than 0.020 inches such that downward force transmitted from the tab heel to the button ruptures the vent score. More preferably the distance D3 or D13 is between approximately −0.010 inches (that is, minus 0.010 inches) and 0.020 inches, or between approximately −0.006 inches and 0.015 inches, even more preferably between approximately 0.000 inches and 0.006 inches.

An aspect of the vent panel can be described by geometrical relationships between some of its portions. In this regard, a dimension X is defined from a button center to lateral ends of the vent score along a vent centerline CL, a dimension Y is defined from the button center to the vent hinge, and a dimension Z is defined from the button center to a proximal point of the vent score, which is the point on the vent score that is closest to the button. In this regard, dimension X is greater than Z and less than 5Z and dimension Y is greater than 0.5Z and less than 3Z. And/or dimension X is greater than 1.2 Z and less than 3Z, and dimension Y is greater than 0.75Z and less than 2Z. Moreover, dimension Y is greater than 0.9Z and less than 1.5Z. And/or dimension Z is between 0.5 and 0.81 of button diameter D1, between 0.55D1 and 0.7D1; and preferably approximately 0.6D1. Moreover, in absolute terms, Z dimension is between 0.0625 and 0.090 inches, preferably between 0.065 and 0.0850 inches, and more preferably between 0.068 and 0.078 inches.

The configuration of the structure is such that in response to downward pressure applied on the tab, the vent score ruptures initially at a point or points at which the vent score is closest to the button sidewall. The tab may be configured such that initial contact by a tab bead against the button is at a location on the button that is proximate where the vent score is closest to the button sidewall. The tab and button may also be configured such that after initial contact, subsequent contact by the tab bead against the button moves from the initial contact point rearward on the button as the vent tear panel pivots about the vent hinge.

The vent hinge is parallel to the long axis of the elongated vent score. Alternatively, vent hinge is perpendicular to the long axis of the elongated vent score. Additional combinations of features are provided below to round out the scope of the disclosure.

According to a first combination of features, a beverage can end has a particular structure and dimensional relationship between a vent score and a button on the vent panel defined or encompassed by the vent score. The end includes a peripheral curl capable of being joined to a can body by seaming; a wall structure radially inward from the curl; a center panel; a main score defining a main hinge and a main tear panel that is capable of opening upon rupture of the score to form a pour opening; a tab coupled to the center panel by a rivet, the tab having a nose capable of contacting a portion of the main tear panel for rupturing the main score, a body, and a heel formed opposite the nose, the heel being configured for grasping by a user. The vent score defines: a vent tear panel; an upwardly protruding button located on the vent tear panel, the button including a sidewall that yields to a radius that merges with a portion of the center panel; and a vent hinge located approximately between opposing ends of the vent score; the vent score having a distance D3 or D13 from the button sidewall, measured at a point at which the vent score is closest to the button sidewall, of no more than 0.020 inches, and preferably between −0.010 inches and 0.020 inches such that downward force transmitted from the tab heel to the button ruptures the score. Actuation of the tab by lifting the heel is capable of rupturing the main score and actuation of the tab by pressing down on the tab is capable of rupturing the vent score. The vent hinge preferably is oriented such that the score rupture propagates about the vent tear panel in two directions to the vent hinge.

In the preferred embodiment, the distance D3 is between −0.010 inches (that is, negative 0.010 inches) and 0.020 inches. More preferably, dimension D3 is between −0.006 inches and 0.015 inches, more preferably −0.003 inches and 0.013 inches, and most preferably between −0.001 or 0.000 inches and 0.006 inches. Measured through the same line as D3, the distance from the centerline of the button to the inboard edge of score 42 preferably is between −0.005 and 0.040 inches (that is, the ranges of R2 plus D3) plus one-half D1. For a button diameter of 0.130 inches, the dimension from the centerline of the button to the inboard edge of score 42 is thus between 0.060 and 0.105 inches.

Preferably, the radius R2 between the button and the center panel or a vent score panel is between approximately 0.005 inches and approximately 0.020 inches, preferably between approximately 0.0075 inches and 0.0115 inches, and more preferably is approximately 0.0095 inches.

The button preferably has a diameter of between approximately 0.10 inches and approximately 0.18 inches, more preferably between of approximately 0.115 inches and approximately 0.15, and preferably approximately 0.130 inches. Preferably, the vent score is not spaced apart from the button sidewall by a uniform distance. The vent in this regard can be configured such that the vent score is closest to the button sidewall at a point that is opposite the hinge. Alternatively the closest location of the vent score to the button sidewall is not opposite the hinge. The vent hinge can be opposite the rivet. Alternatively, the vent hinge is on a side of the button proximate the rivet.

The tab has a contact element that is configured to contact the button. The tab contact element may be a downwardly protruding bead that is elongate and sized to enable the tab bead to enter into the vent aperture formed by depressing the vent tear panel. The tab bead may be curved at a radius that is approximately equal to the distance between a center of the rivet and the vent button to promote contact between the tab bead and the button and enable good contact at a wide range of angular positions of the tab.

The structure of the tab bead and the vent button and the relative locations and dimensions of the parts of the end may be configured such that during the process of opening the vent, in response to downward pressure applied on the tab by a user, the vent score ruptures initially at a point at which the vent score is closest to the button sidewall. In this regard, the tab is configured such that initial contact by a tab bead against the button is at a location on the button that is proximate where the vent score is closest to the button sidewall. Further, the tab and button may be configured such that after initial contact, subsequent contact by the tab bead against the button moves from the initial contact point rearward on the button as the vent tear panel pivots about the hinge.

A vent button and score preferably has a layout that promotes reliable opening. The vent preferably defines: a dimension X from a button center to lateral ends of the vent score along a vent centerline CL, a dimension Y from the button center to the vent hinge, and a dimension Z from the button center to a proximal point of the vent score, which is the point on the score that is closest to the button. Dimension X is greater than Z and less than 5Z and dimension Y is greater than 0.5Z and less than 3Z. Preferably, dimension X is greater than 1.2 Z and less than 3Z, and dimension Y is greater than 0.75Z and less than 2Z, and more preferably dimension Y is greater than 0.9Z and less than 1.5Z. For conventional beverage can ends, the Z dimension preferably is between 0.0625 and 0.090 inches, and more preferably between 0.065 and 0.085 inches, and more preferably between 0.068 and 0.078 inches. In one embodiment (for example as shown in FIG. 2), dimension Z is 0.083 inches. The X and Y dimensions and ranges can be calculated from the preferred Z dimensions.

In another embodiment, dimensions for score 142 preferably are X of approximately 0.143 inches, Y of approximately 0.101 inches, and Z of approximately 0.083 inches. Dimension Z preferably is between 0.2X and 1X, and most preferably between 0.33X and 0.83X. Dimension Z preferably is between 0.5Y and 1.33Y, and most preferably between 0.67Y and 1.1Y.

Dimension Z may also be defined as a ratio of button diameter D1. In this regard, dimension Z may be approximately between 0.5D1 and 0.81D1, preferably approximately between 0.55D1 and 0.7D1, and in the preferred embodiment approximately 0.6D1. As Y encompasses a dimension less than D1, the hinge may intersect with the button structure such that upon actuation of the vent panel, the hinge forms not in a straight line but forms around the button. The vent score may be formed in a local recess for any of the above structure.

According to a second combination of end features, the vent score, which at least partially defines the vent tear panel, may be located in a local recess or deboss portion. In this regard, the beverage can end may include: a peripheral curl capable of being joined to a can body by seaming; a wall structure radially inward from the curl; a center panel; a main score defining a main hinge and a main tear panel that is capable of opening upon rupture of the score to form a pour opening; a tab coupled to the center panel by a rivet, the tab having a nose capable of contacting a portion of the main tear panel for rupturing the main score, a body, and a heel formed opposite the nose, the heel being configured for grasping by a user, and a vent. The vent score defines a vent tear panel and there is an upwardly protruding button located on the vent tear panel. A vent hinge is located approximately between opposing ends of the vent score; and a vent recess is formed in the center panel, and the vent tear panel is located in the vent panel recess. Actuation of the tab by lifting the heel is capable of rupturing the main score and actuation of the tab by pressing down on the tab is capable of rupturing the vent score after the tab is pivoted over the vent panel button. The inventors believe that the local vent recess can counter the effects of slack metal formed by the vent score and anti-fracture score. The depth and diameter of the vent recess may be chosen according to industry practice according to variables of aluminum thickness, vent size and score configuration, and other parameters.

Preferably, the center panel further includes a main recess of the general type that are known in the art and associated with a "Stolle-style" center panel, but such recess is not required. If present, each one of main score, rivet, and vent panel recess may be formed in the main recess. In order to locate the vent button at a location at which is it not inadvertently opened by unintentional downward force on the bead, the vent button may be located on the center panel at a place that is not underneath the tab or its vertical projection while the tab is in its as-manufactured state. Preferably, the as-manufactured state places the tab in a position for opening the main pour opening by rupture of the main score. Further, the location of the vent preferably is high on the center panel (that is, when the can is oriented for pouring or drinking or when the center panel is nearly vertical), as the vent panel recess preferably is tangential to a periphery of the main recess and near the tab. In this regard, choosing the location of the vent so that it is at a point relatively high on the center panel enhances the venting function during pouring, and choosing the location of the vent outside of the projection of the tab and even spaced apart from the tab makes inadvertent tab rupture unlikely. Also, the vent is configured such that the main recess is not symmetrical about its centerline.

Another combination of features of the vent promotes a large venting area formed between the periphery of the vent tear panel and the stationary remainder of the end, especially when viewed as a function of vent tear panel angular deflection. In this regard, the beverage can end includes: a peripheral curl capable of being joined to a can body by seaming; a wall structure radially inward from the curl; a center panel; a main score defining a main hinge and a main tear panel that is capable of opening upon rupture of the score to form a pour opening; a tab coupled to the center panel by a rivet, the tab having a nose capable of contacting a portion of the main tear panel for rupturing the main score, a body, and a heel formed opposite the nose, the heel being configured for grasping by a user; and an elongated vent score.

The elongated vent score defines or encompasses a vent tear panel. An upwardly protruding button is located on the vent tear panel, the button including a sidewall that yields to a radius that merges with a portion of the center panel. A vent hinge is located approximately between opposing ends of the vent score. The elongated vent score provides enhanced venting capacity upon deflection of the vent tear panel after rupture.

Preferably, the tab includes an elongated bead on an underside of the tab proximate the heel. The tab and vent score are configured such that after actuation of the tab bead against the vent button, the tab bead is configured to enter into opening created upon rupture of the vent score to enhance deflection of the vent tear panel. The vent hinge may be oriented such that it is parallel to the long axis of the elongated vent score or perpendicular to the long axis of the elongated vent score.

According to a fourth combination of end features, a configuration of the vent button, vent score, and vent hinge are chosen to provide reliable opening and adequate strength in commercial quantities. Thus, the beverage can end includes a peripheral curl capable of being joined to a can body by seaming; a wall structure radially inward from the curl; a center panel; a main score defining a main hinge and a main tear panel that is capable of opening upon rupture of the score to form a pour opening; a tab coupled to the center panel by a rivet, the tab having a nose capable of contacting a portion of the main tear panel for rupturing the main score, a body, and a heel formed opposite the nose, the heel being configured for grasping by a user; and a vent.

The vent has a vent score that defines or encompasses a vent tear panel. An upwardly protruding button is located on the vent tear panel, the button including a sidewall that yields to a radius that merges with a portion of the center panel. A vent hinge is located approximately between opposing ends of the vent score. The vent tear panel defines a dimension X from a button center to lateral ends of the vent score along a vent centerline CL, a dimension Y from the button center to the vent hinge, and a dimension Z from the button center to a proximal point of the vent score, which is the point on the score that is closest to the button.

Regarding preferred relationships, dimension X is greater than Z and less than 5Z and dimension Y is greater than 0.5Z and less than 3Z. Preferably, dimension X is greater than 1.2 Z and less than 3Z, and dimension Y is greater than 0.75Z and less than 2Z, and more preferably dimension Y is greater than 0.9Z and less than 1.5Z. For conventional beverage can ends, the Z dimension preferably is between 0.0625 and 0.090 inches, and more preferably between 0.065 and 0.085 inches, and more preferably between 0.068 and 0.078 inches. The X and Y dimensions and ranges can be calculated from the preferred Z dimensions.

In another embodiment, dimensions for score 142 preferably are X of approximately 0.143 inches, Y of approximately 0.0.101 inches, and Z of approximately 0.083 inches. Dimension Z preferably is between 0.2X and 1X, and most preferably between 0.33X and 0.83X. Dimension Z preferably is between 0.5Y and 1.33Y, and most preferably between 0.67Y and 1.1Y.

Dimension Z may also be defined as a ratio of button diameter D1. In this regard, dimension Z may be approximately between 0.5D1 and 0.81D1, preferably approximately between 0.55D1 and 0.7D1, and in the preferred embodiment approximately 0.6D1. As Y encompasses a dimension less than D1, the hinge may intersect with the button structure such that the upon actuation of the vent panel, the hinge forms not in a straight line but forms around the button. The vent score may be formed in a local recess for any of the above structure.

The vent score preferably has a distance D3 or D13 from the button sidewall, measured at a point at which the vent score is closest to the button sidewall, between −0.010 inches (that is, negative 0.010 inches) and 0.020 inches such that downward force transmitted from the tab heel to the button ruptures the score. Preferably the distance D3 or D13 is between −0.006 inches and 0.015 inches, more preferably −0.003 inches and 0.013 inches, and most preferably between −0.001 or 0.000 inches and 0.006 inches.

The tab has a contact element that is configured to contact the button, which preferably is a downwardly protruding bead that is elongate and sized to enable the tab bead to enter into the vent aperture formed by depressing the vent tear panel. In response to downward pressure applied on the tab, the vent score ruptures initially at a point at which the vent score is closest to the button sidewall.

Preferably, the tab is configured such that initial contact by a tab bead against the button is at a location on the button that is proximate where the vent score is closest to the button sidewall. Further, the tab and button can be configured such that after initial contact, subsequent contact by the tab bead against the button moves from the initial contact point rearward on the button as the vent tear panel pivots about the hinge. Preferably, the center panel includes a vent recess formed in a main recess and the vent tear panel is located in the vent panel recess.

According to a fifth combination of end features, a beverage tab may be configured to enhance venting. In this regard, the contact between the tab and the vent structures occurs at a point or a line that moves rearward toward the hinge as the vent opens to promote deflection of the vent panel. The beverage can end configured in this way may include a peripheral curl capable of being joined to a can body by seaming; a wall structure radially inward from the curl; a center panel; a main score defining a main hinge and a main tear panel that is capable of opening upon rupture of the score to form a pour opening; and a tab coupled to the center panel by a rivet. The tab has a nose capable of contacting a portion of the main tear panel for rupturing the score, a body, a heel formed opposite the nose, the heel being configured for grasping by a user, and a downwardly extending bead on an underside of the tab proximate the heel.

The fifth end also includes a vent. A vent score defines or encompasses a vent tear panel. An upwardly protruding button is located on the vent tear panel, the button including a sidewall that yields to a radius that merges with a portion of the center panel. A vent hinge is located approximately between opposing ends of the vent score. The tab is configured such that a first contact by a tab bead against the button is at a location on the button that is referred to as an initial contact point. After the initial contact, subsequent contact by the tab bead against the button moves from the initial contact point rearward on the button as the vent tear panel pivots about the hinge (that is, the point of contact moves relative to the rivet and on the button). Preferably, the vent hinge is opposite the rivet.

Preferably the button and tab are configured such that the vent score has a distance D3 or D13 from the button sidewall, measured at a point at which the vent score is closest to the button sidewall, of between −0.010 inches (that is, negative 0.010 inches) and 0.020 inches such that downward force transmitted from the tab heel to the button ruptures the score. Preferably the distance D3 or D13 is between −0.006 inches and 0.015 inches, more preferably −0.003 inches and 0.013 inches, and most preferably between −0.001 or 0.000 inches and 0.006 inches. And the button preferably the button has a diameter of approximately 0.130 inches. The tab bead may be curved at a radius that is approximately equal to the distance between a center of the rivet and the vent button.

Preferably, the closest location of the vent score to the button sidewall is opposite the vent hinge. Alternatively, the closest location of the vent score to the button sidewall is not opposite the vent hinge. The tab may configured such that initial contact by a tab bead against the button is at a location on the button that is proximate where the vent score is closest to the button sidewall.

The tab has a contact element that is configured to contact the button, which preferably is a downwardly protruding bead that is elongate and sized to enable the tab bead to enter into the vent aperture formed by depressing the vent tear panel. In response to downward pressure applied on the tab, the vent score preferably ruptures initially at a point at which the vent score is closest to the button sidewall. The tab bead may curved at a radius that is approximately equal to the distance between a center of the rivet and the vent button.

Further, the vent configuration may define X, Y, and Z dimensions and relationships as described above. And the vent may be formed in a vent recess formed in the center panel and in the main recess.

A method of opening and venting a beverage can begins with the end structure described in any of the above paragraphs. The method includes (i) actuating the tab to press against the main tear panel and to rupture the main score, thereby forming a pour opening; (ii) pivoting the tab such that the tab is capable of contacting the vent button; and (iii) after the pivoting step, applying a downward force on the tab to provide a force on the button via an underside of the tab at an initial contact point and then applying a downward force to rupture the vent score and open the vent such that the contact by the tab on the button moves rearward on the button from the initial contact as the vent tear panel pivots about the vent hinge. The vent may be opened before or after the pour opening is formed in step (i).

A beverage can and end combination holding a carbonated beverage, otherwise pressurized can, or an unpressurized can is also provided. The inventive vented can end may use any can end described herein. The present invention encompasses the corresponding method of actuating the beverage can end for each of the embodiments and for any combination of the features provided.

DETAILED DESCRIPTION OF ILLUSTRATIVE EMBODIMENTS

Figure 6:
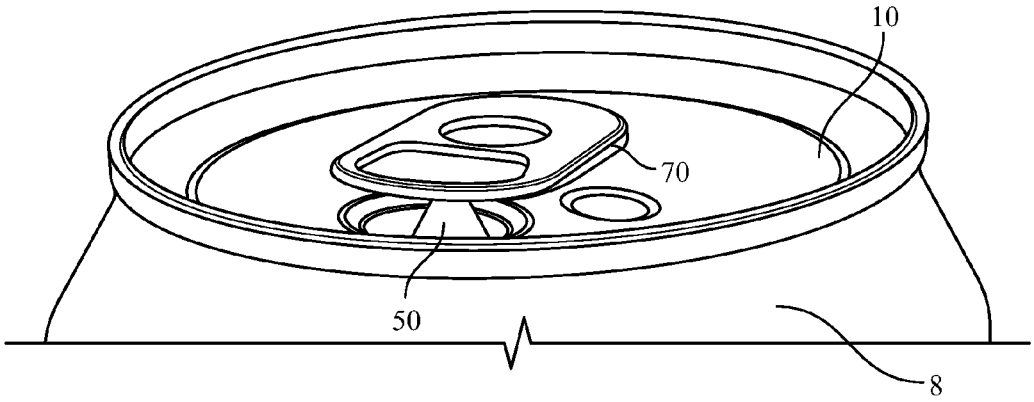
FIG. 6 is a can body and can end combination showing the tab over the vent opening with the vent in its unactuated, unvented state.

Referring to FIGS. 1 through 6 to illustrate a first embodiment, a beverage can end 10 formed of an aluminum alloy (preferably a 5000 series alloy) has a shell that includes a peripheral curl 12, a wall structure 14, an annular bead 16, and a center panel 18. Can end 10 also includes a vent 40 formed on the center panel and a tab 70 affixed to the shell by a rivet. FIGS. 1 through 5 show can end 10 in its unseamed state. FIG. 6 shows a can end and can body combination holding a carbonated beverage.

Curl 12 is configured to be seamed to a flange of an aluminum can body 8, preferably by a conventional double seam.

The can body and can end combination, joined by a double seam, is shown in FIG. 6. Wall structure 14 extends from curl 12 and preferably is of a type found on conventional, lightweight ends. In this regard, wall structure 14 is inclined as shown in the figures, and also may encompass curved portions, kicks, kinks, double angles, and like structure known in the field. Countersink bead 16 is located at the base of wall structure 14. Center panel 18 extends from countersink bead 16. The present invention also encompasses a panel wall or chamfer (not shown in the figures) that merges with inner wall of bead 16 and center panel 18.

Center panel 18 is flat, which encompasses variations from a theoretical plane because of manufacturing tolerances and some inherent deviations from a perfect plane, and also structural features, such as deboss panels and beads described herein and the like. The term flat is used to encompass both the unseamed end and the curvature under normal pressurized conditions from holding a carbonated beverage. A rivet 22 is formed in center panel 18 preferably in the center of center panel 18. A main score 26 is formed in center panel 18 in an oblong shape and preferably defines a main tear panel 28, which forms a pour opening upon rupture of the score. Opposing ends of score 26 form a main hinge 30 about which the tear panel pivots during actuation of tab 70. Main score 26 and tear panel 28 preferably are conventional. For example, the tear panel may have an aspect ratio of between 1.3 and 1.7. As shown in the figures, center panel 18 includes a main deboss panel 34—that is, a recess in panel 18. The present invention is not limited to ends having a main deboss panel unless specifically required by the claims. Rather, the present invention encompasses ends that do not have a main deboss panel, which ends may have beads formed on the center panel, as is known in the field.

In a first embodiment, vent 40 includes a vent score 42, a vent hinge 46, a vent anti-fracture score 48, and an upwardly protruding button 50. Preferably, vent 40 is located within a vent recess or deboss panel 62, which is formed in main deboss panel 34. Deboss panel 62 has a diameter that preferably is at least 0.5 inches, preferably less than 0.7 inches, and in the embodiment shown approximately 0.63 inches. Deboss panel 62 may stiffen the region around vent 40 to enhance openability. The depth of vent deboss panel 62 may be chosen with the end goal of panel stiffness and minimum slack metal without putting undue stress on vent score 42. In this regard, the size of the vent panel may be chosen according to parameters that will be understood by persons familiar with end forming technology upon consideration of the present disclosure, taking into account the parameters of vent score dimensions and configuration, button size and configuration, relationship to other recesses or beads, depth of recesses, and the like.

Figure 1:
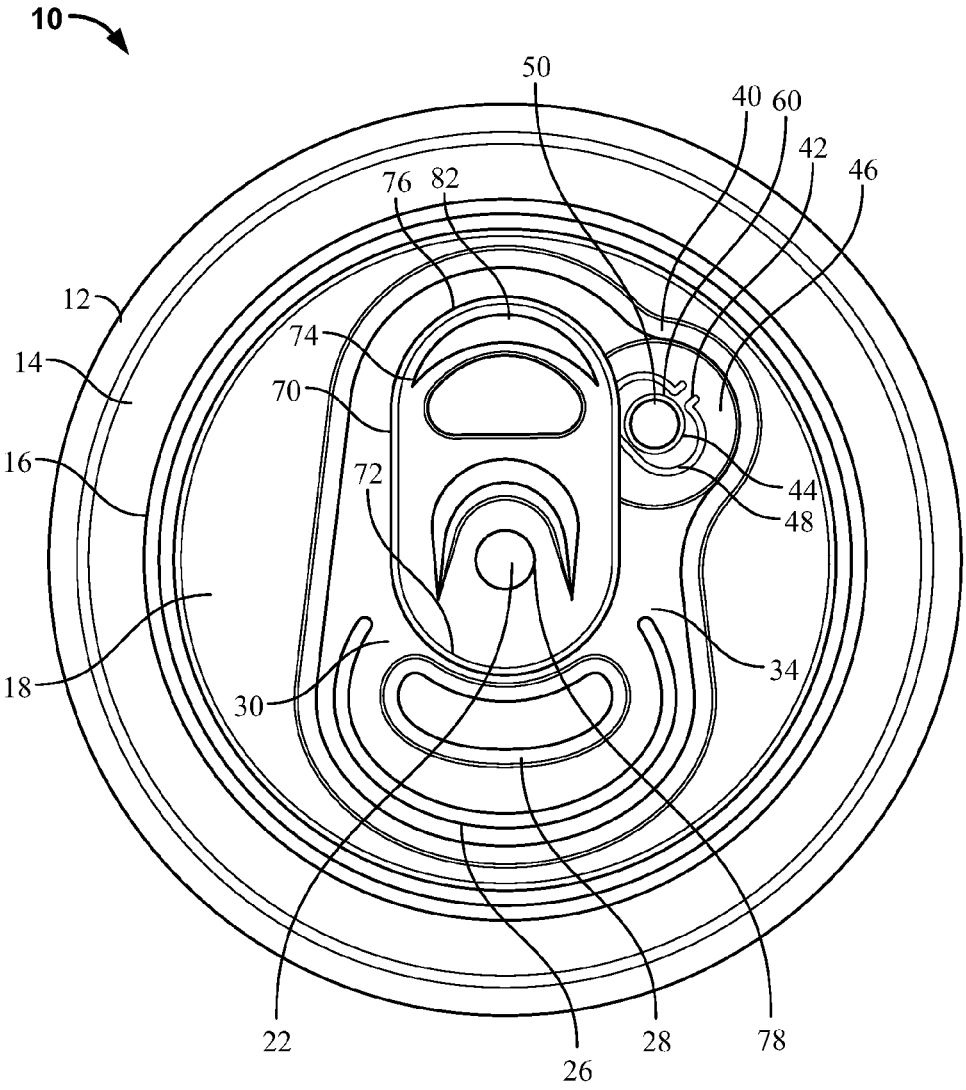
FIG. 1 is a top view of a can end according to a first embodiment of the present invention.

Vent deboss panel 62 preferably is located such that button 50 is not beneath tab 70 or is not beneath a downwardly protruding bead, described below, while the tab is in its as-manufactured or shipping configuration or in the position in which is configured to actuate main score 26. In this regard, button 50, especially the center or a contact portion of button 50, may be outboard of the side of tab 70 such that a downward force on tab 70 does not apply a force on button 50 until a user pivots or rotates tab 70 for the purpose of aligning the tab contact surface with button 50. Further, deboss panel 62 preferably is located distally from main score 26 while still being formed in main recess panel 34 (although it is not required that the deboss panel be located in the main recess panel) such that vent 40 can be located at or near the highest feasible point on the end when the can is tilted into a pouring position or when the can is horizontal and the end is vertical. Accordingly and as shown in FIG. 1, an edge or sidewall of vent deboss 62 may be tangential to or in part coextensive with an edge or sidewall of main deboss panel 34. In this configuration, main recess panel 34 is asymmetrical about its longitudinal centerline, which is unlike conventional Stolle-style recess panels. The longitudinal axis of main recess panel 34 is defined as a line through the rivet, approximately through the center of the tear panel, and through the bottom center of the edge of main recess panel.

Figure 8:
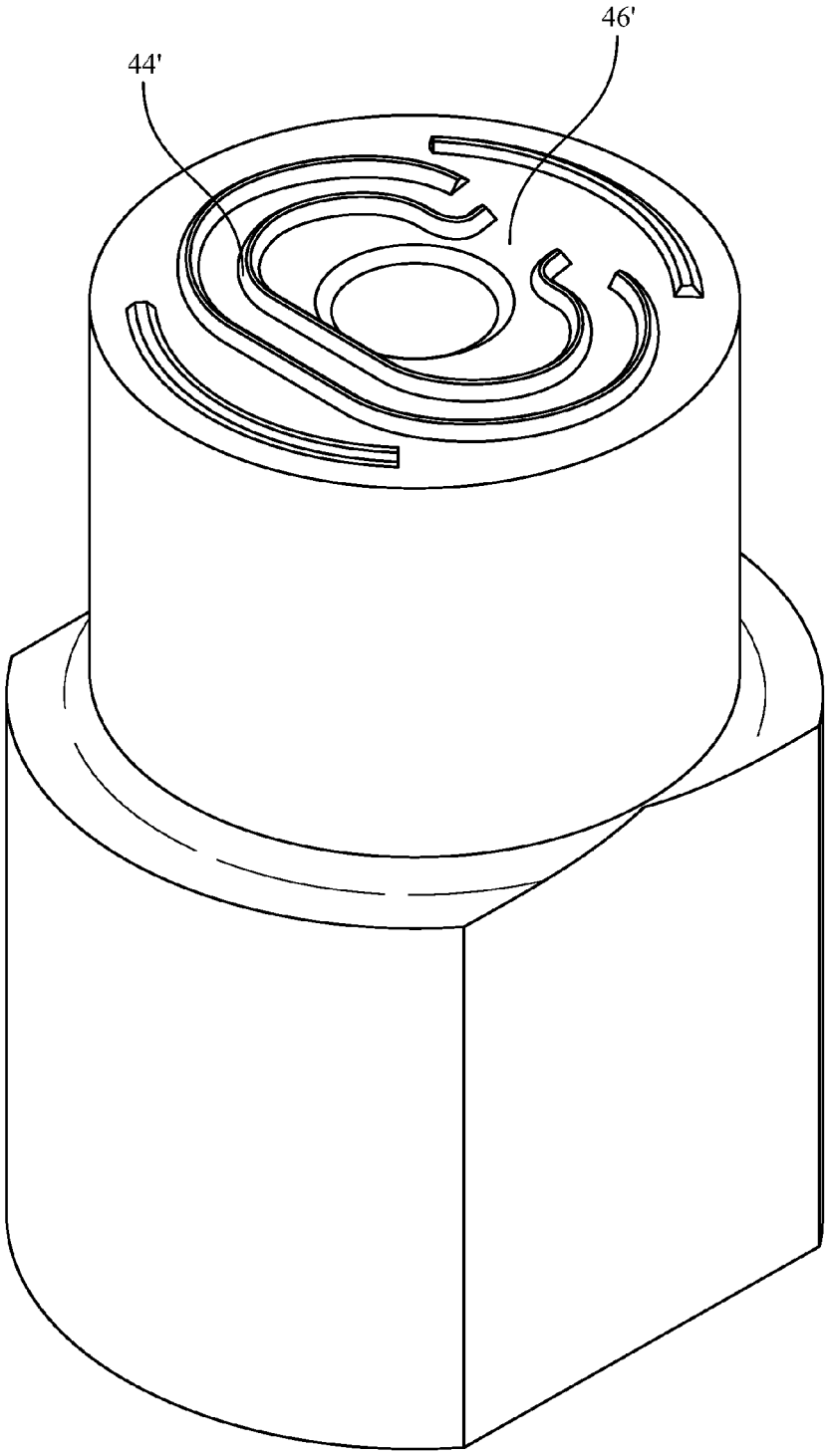
FIG. 8 is a perspective view of a tooling insert used to form the vent score portion of the end shown in FIG. 2.
Figure 9:
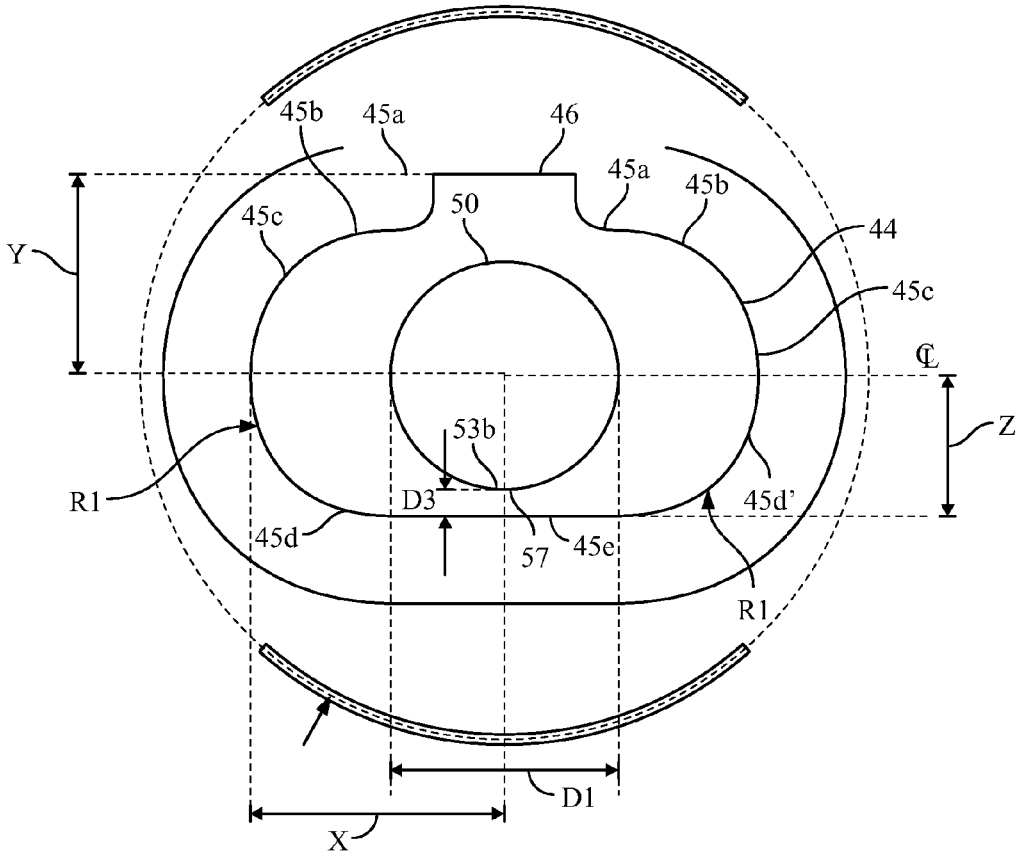
FIG. 9 is an enlarged plan view of a portion of a vent portion of the end shown in FIG. 2.

FIG. 8 is a tooling insert used to form vent score 42 of vent 40. FIG. 9 is an enlarged view of the structure that partly is formed by the tooling insert of FIG. 8. For convenience of illustration and dimensional precision and accuracy, the description of the tooling insert and the corresponding structure are provided together, and it is understood that description of the tool applies to description of the vent structure formed from the tool. A prime designation (') is used to refer to structure on the tool, as distinguished from corresponding structure in an end, as needed.

As best shown in FIG. 9, vent score 42 includes a longitudinal centerline CL that is parallel to hinge 46. Vent score 42 includes a pair of opposing ends 45*a*. On each side, score 42 merges from end 45*a* via a transition 45*b* to first and second curved portions 45*c* and 45*d*, which meet at a side 45*e*, which preferably is straight. Preferably, the radii of curved transition portions 45*c* and 45*d* are approximately 0.083 inches. R1 in FIG. 9 identifies radii 45*d*.

Button 50 is formed within score 42. For convenience and according to industry custom, dimensions are provided here for the tooling and it is understood that dimensions in the finished end will follow from the tooling dimensions, with some variation for manufacturing deviations, such as spring back or tool wear. For precision in claiming, the dimensions are applied to the end structure and may be measured on the end.

Figure 7:
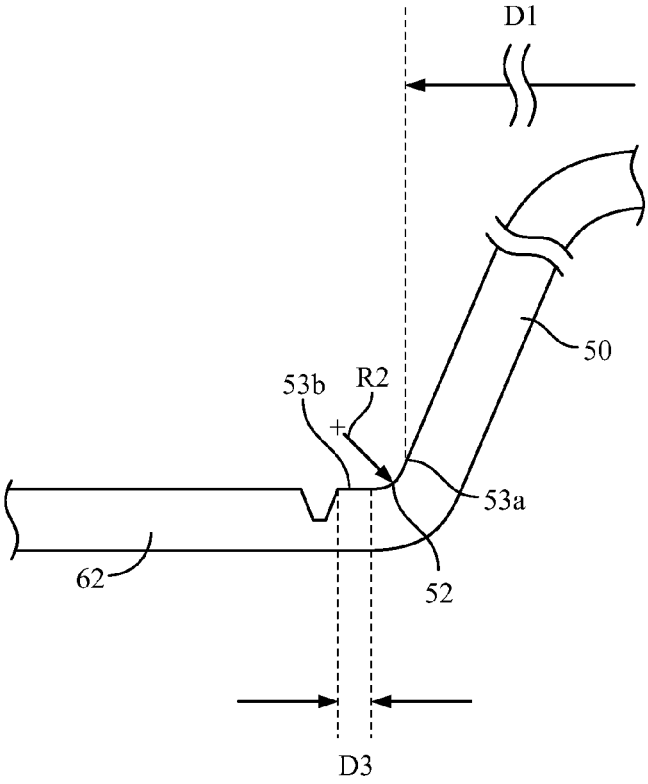
FIG. 7 is an enlarged schematic view of a portion of the button on the vent.

Button 50, as shown schematically in FIG. 7, rises from deboss panel 62 of center panel 18 via a radiused or curved transition 52. If the vent score is formed in the main recess of the center panel or in the unrecessed portion of the center panel, curved transition 52 merges from the main recess or unrecessed portion. Curved transition 52 merges into a button sidewall 54 which extends to yield to a button top 56. Curved transition 52 extends between inboard point 53*a* that merges into sidewall 54 and outboard point 53*b* that merges with center panel 18 or, more specifically, deboss panel 62. Preferably, curved transition 52 has a radius R2 (FIG. 7) that is between 0.005 inches and 0.020 inches, more preferably between 0.0075 inches and 0.0115 inches, and most preferably approximately 0.0095 inches.

The inventors have found that choosing the distance between the score and the button sidewall 54 is helpful in some embodiments in enabling the vent opening to controllably and repeatably open. The distance can be measured from the outboard point 53*b* of radius R2 to the inside wall of score 42, as best shown in FIG. 7 by distance D3. The distance D3 is measured at the point at which the vent score is closest to the button sidewall, referred to as proximal point 57, as explained below. FIG. 9 shows button 50 and illustrates dimension D3 that is measured from point 53*b* at the circumferential position identified by proximal point 57.

Preferably, dimension D3 is between −0.010 inches (that is, negative 0.010 inches) and 0.020 inches. The negative range means that the inner wall of vent score 42 can be located on or in button curved transition 52 or button sidewall—that is, on the inboard side (that is, to the right as oriented in FIG. 7) of outboard point 53*b*. Because the range of D3 encompasses zero, the inner wall of vent score 42 may be on the point 53*b* at which curved transition 52 ends or merges on to center panel 18. And the dimension encompasses a vent score that is located up to 0.020 inches away from the point 53*b* (that is, outwardly from the button). More preferably, dimension D3 is between −0.006 inches and 0.015 inches, more preferably between −0.003 inches and 0.013 inches, and most preferably between −0.001 or 0.000 inches and 0.006 inches. Measured through the same line as D3, the distance from the centerline of the button to inboard edge of score 42 is between −0.005 and 0.040 inches plus one-half D1, which represents radius R2 plus dimension D3 plus the button radius. For a button diameter of 0.130 inches, the dimension from the centerline of the button to the inboard edge of score 42 is thus between 0.060 and 0.105 inches.

Button 50 preferably has a diameter of between 0.100 inches and 0.180 inches, more preferably, between approximately 0.115 inches and 0.15 inches, and most preferably approximately 0.130 inches. The diameter of button 50 is represented as D1 on FIGS. 7 and 9. For ease of measurement, D1 (and D13 below) is measured on the button 50 at point 53*a* and the point opposite 53*a*. Conceptually, curved transition 52 can be considered to be part of button 50 even though curved transition 52 is excluded from the measurement of D1 in the embodiments shown. Button 50 as shown in the figures is circular in top view, but the present invention is not limited to circular buttons. Button 50 is illustrated in the figures having a straight sidewall 54, and the present invention encompasses curved sidewalls and tops and a combination of curves and straight portions forming the button sidewall 54 and button top 56. Thus, the present invention encompasses forming the vent score anywhere on the button sidewall. Use of the term "button sidewall" is intended to cover the entire surface of the button.

Figure 2:
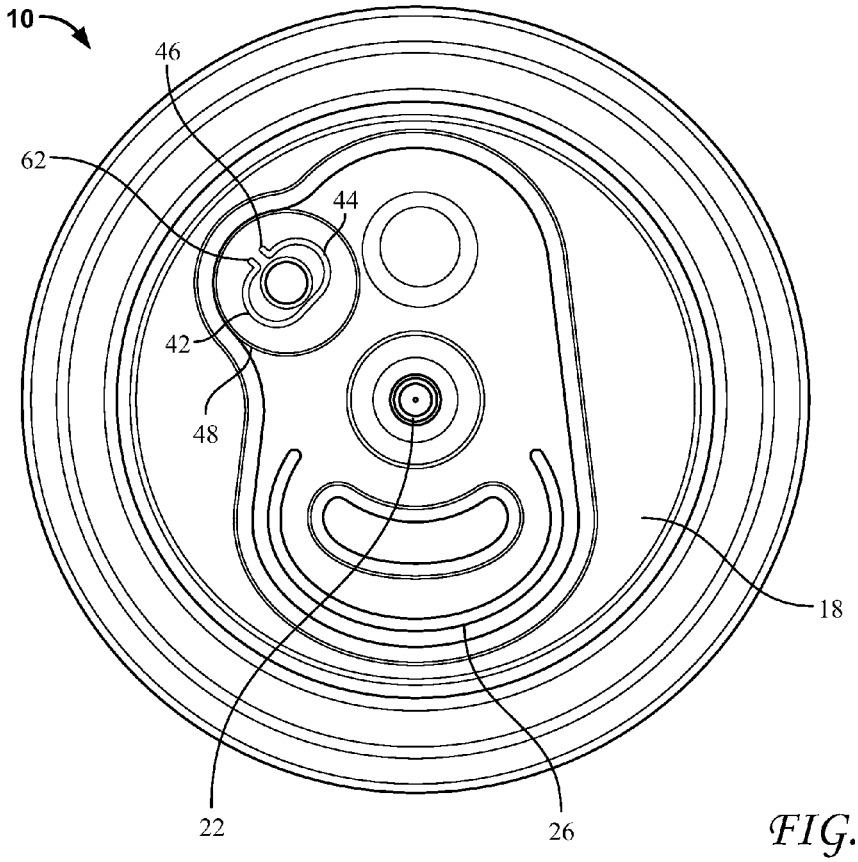
FIG. 2 is an underside view of the can end of FIG. 1.
Figure 3:
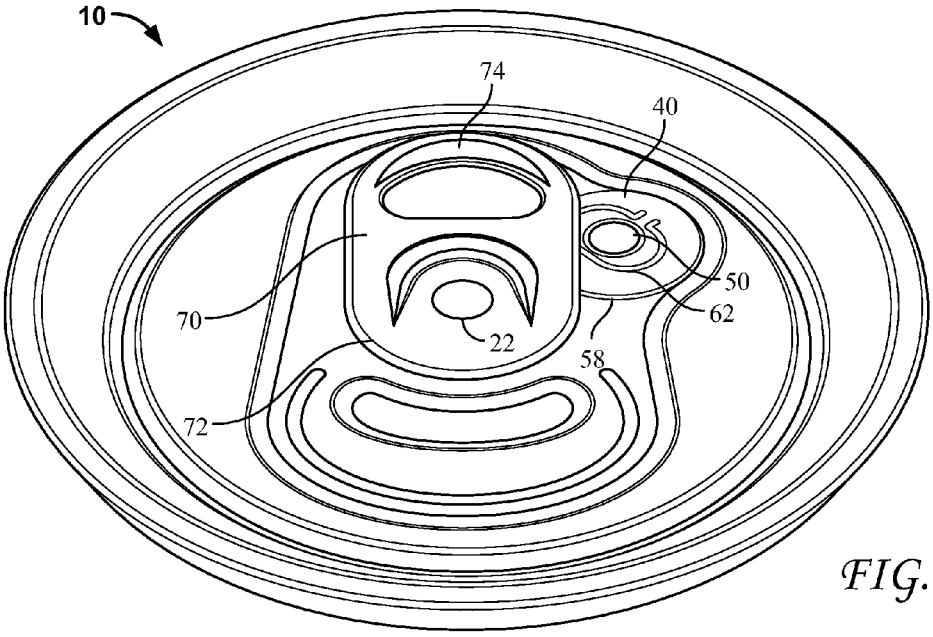
FIG. 3 is a perspective view of the can end of FIG. 1.

A proximal point 57 is defined as the point on score 42 that is closest to button sidewall 54—specifically, closest to outboard radius point 53*b* of the button. To enhance the effectiveness of the transfer of force through button 50 to score 42, in the embodiment shown in FIG. 9, proximal point 57 is located on the side of the button opposite the vent hinge 46. Further, vent hinge 46 preferably is opposite the rivet 22 relative to the button 50, as shown in FIG. 2. The present invention also encompasses the vent hinge proximate the rivet 22 rather than opposite it, as well as other locations.

Dimension X is the distance from the button center to the lateral ends of score 42' along longitudinal centerline CL. Dimension Y is the distance from the button center to the vent hinge 46. Dimension Z is the distance from the button center to the proximal point of score 42 opposite hinge 46 (that is, to proximal point 57). Alternatively, dimension Z can be defined as parallel and opposite to dimension Y (as for example in the embodiment shown in FIG. 9). For the particular dimensions below, the diameter D1 of button 50 is 0.130 inches, even though D1 and the dimensions for X, Y, and Z dimensions may vary according to particular design parameters. The inventors surmise that various configurations of vent scores would achieve reliable opening characteristics. In this regard, preferably, dimension X is greater than Z and less than 5Z. Preferably dimension Y is greater than 0.5Z and less than 3Z. More preferably, dimension X is greater than 1.2Z and less than 3Z, and dimension Y is greater than 0.75Z and less than 2Z, and more preferably dimension Y is greater than 0.9Z and less than 1.5Z. The Z dimension preferably is between 0.0625 and 0.090 inches, and more preferably between 0.065 and 0.085 inches, and more preferably between 0.068 and 0.078 inches. In the embodiment shown in FIG. 2, X is approximately 0.150 inches and Z is approximately 0.83 inches and Y is approximately 0.117 inches, each with button 50 described herein. It is clear that the present invention encompasses vent configuration that are symmetrical and ones that are asymmetrical.

Figure 10:
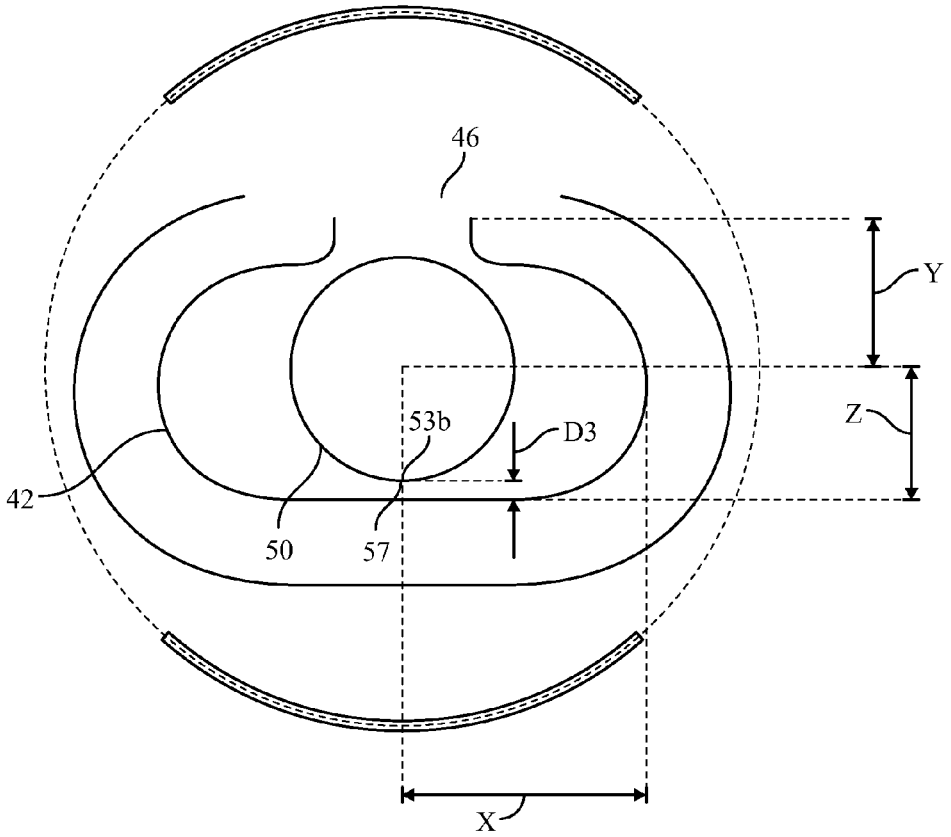
FIG. 10 is an enlarged plan view of a second embodiment of a portion of a vent portion of an end.
Figure 11:
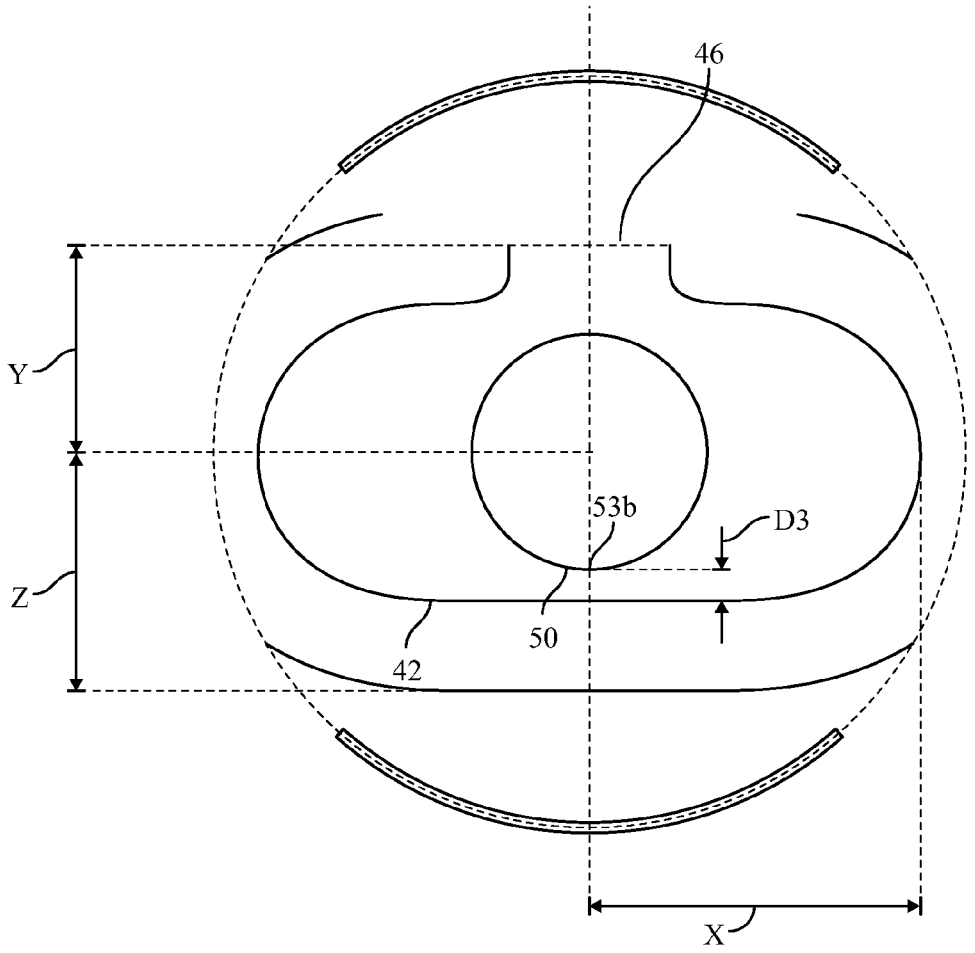
FIG. 11 is an enlarged plan view of a third embodiment of a portion of a vent portion of an end.

The present invention encompasses a vent score having other dimensions. For example, the vent score and button 50 may be configured such that X dimension is approximately 0.150 inches, Y dimension is approximately 0.082 inches, Z dimension is approximately 0.067 inches, and button diameter D1 is approximately 0.130 inches, which configuration is illustrated in FIG. 10. For another example, the vent score and button 50 may be configured such that X dimension is approximately 0.183 inches, Y dimension is approximately 0.108 inches, Z dimension is approximately 0.083 inches, and button diameter D1 is approximately 0.130 inches, which configuration is illustrated in FIG. 11. In the embodiment of FIG. 11, the width of vent score 42 is large relative to the width of deboss panel 62 such that a portion of antifracture score 48 is omitted. A circular vent score (not shown in the figures) with a button as describe herein is also contemplated, which circular vent score has an X dimension of approximately 0.083 inches, a Y dimension of approximately 0.133 inches, a Z dimension of approximately 0.083 inches, and a button dimension of approximately 0.130 inches.

Tab 70 is an elongate, stay-on-tab that includes a nose 72, an elongate body 74, and a heel 76. A rivet island 78 extends below the main portion of body 74 and is flat against center panel. Preferably, opposing sides of body 74 are parallel or approximately parallel. Rivet 22 extends through a hole in rivet island 78 to affix the tab and shell together. As is conventional, tab 70 includes a hinge 80 about which the tab pivots during conventional actuation to form the main opening.

Figure 4:
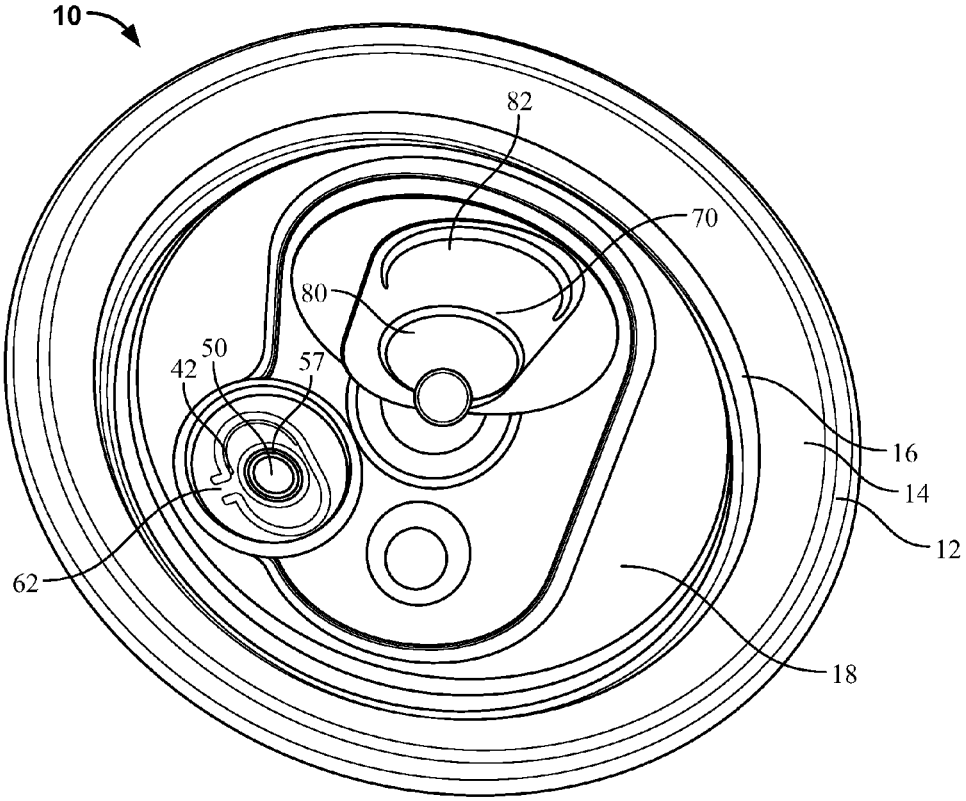
FIG. 4 is a top perspective view of the can end of FIG. 1 showing the tab actuated to open the pour opening.
Figure 5:
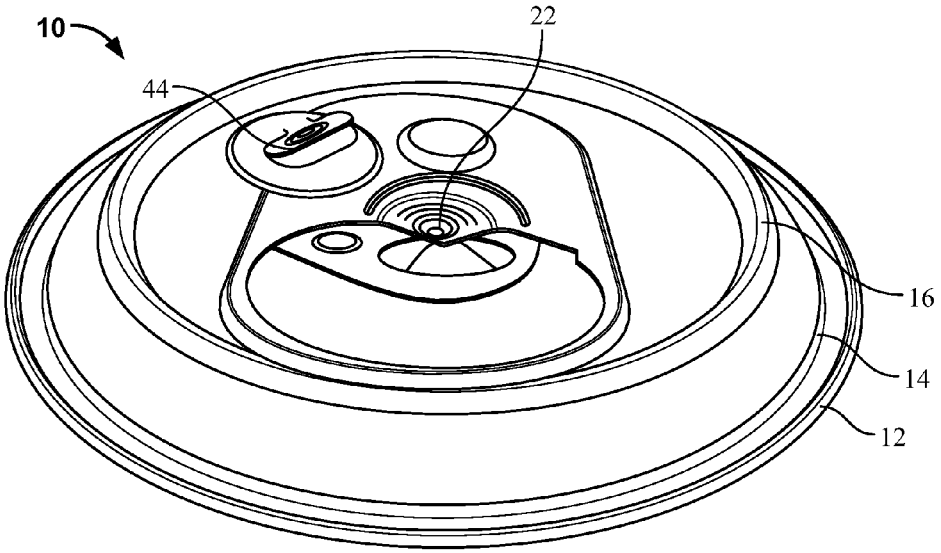
FIG. 5 is an underside perspective view of the can end of FIG. 1 shown the vent opening actuated to its open position and having the main tear panel removed for clarity.

A bead 82 is formed in tab body 74 near heel 76, as directly shown in FIG. 4 and shown in the negative in other figures. Bead 82 extends downwardly relative to the surrounding portion of body 74 and preferably is elongate. Bead 82 may be curved or straight in plan view. Preferably, bead 82 is sized and positioned such that at least a portion of bead 82 and preferably the entire extent of bead 82 is capable of entering into the opened vent 40 when actuating vent tear panel 44, as best shown in FIG. 13C. The present invention encompasses configurations of the center panel, tab, and vent in which a tab bead or tab structure do not enter into the opened vent.

Figure 12:
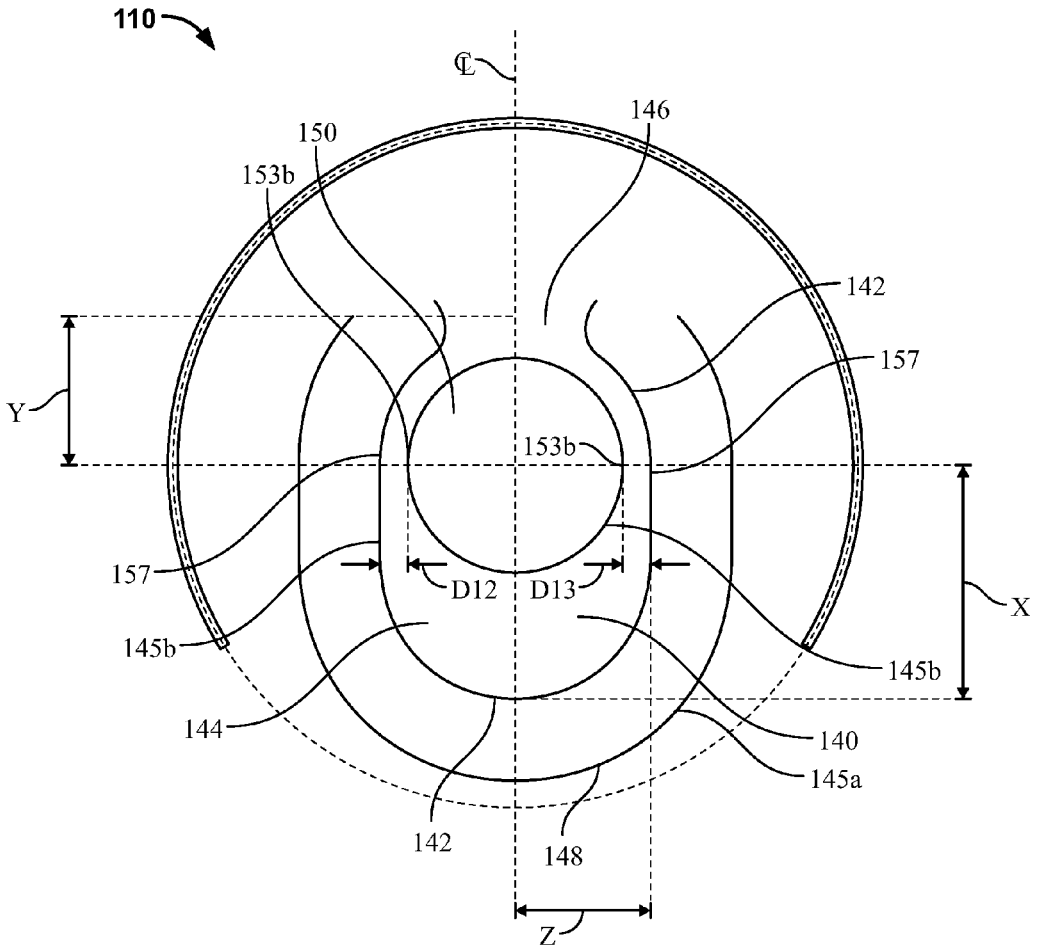
FIG. 12 is an enlarged plan view of a fourth embodiment of a portion of a vent portion of an end.

FIG. 12 illustrates a second embodiment of a vent, designated as vent 140 for a second embodiment end 110. The shell, tab, and recesses of end 110 preferably have identical structure for first embodiment end 10 but for the vent. Vent 140 includes a vent score 142, a vent tear panel 144, a vent hinge 146, a vent anti-fracture score 148, and a button 150. Preferably, vent 140 is located within a recess or deboss panel 62, which is formed in main deboss panel 34, which structure is described above.

Vent score 142 includes a longitudinal centerline CL that is perpendicular to hinge 146. Vent score 142 includes an end 145*a*, which is distal to hinge 146. On each side, score 142 extends from end 145*a* via straight sides 145*b* toward hinge 146. Dimensions for score 142 preferably are X of approximately 0.143 inches, Y of approximately 0.101 inches, and Z of approximately 0.083 inches. Dimension Z preferably is between 0.2X and 1X, and most preferably between 0.33X and 0.83X. Dimension Z preferably is between 0.5Y and 1.33Y, and most preferably between 0.67Y and 1.1Y Button 150 preferably has the same structure as that described for button 50 of the first embodiment vent, including a diameter of approximately 0.130 inches. Preferably button 150 is located closer to hinge 146 than to score end 145*a* and in this regard is off center. A proximal point 157 is defined as the point on the score 142 that is closest to button 150 and defines a distance therebetween as D13. Because of the configuration of score 142, the second embodiment vent has a pair of proximal points 157 on opposing sides of button 150.

Preferably, dimension D13 is between −0.010 inches (that is, negative 0.010 inches) and 0.020 inches. More preferably, dimension D13 is between −0.006 inches and 0.015 inches, more preferably −0.003 inches and 0.013 inches, and most preferably between −0.001 or 0.000 inches and 0.006 inches. As shown in FIG. 12, D13 is measured from a point labeled 153*b* which corresponds defined like point 53*b* in FIG. 7.

In its rest, as-manufactured state, button 50 (and 150) lie outside of the tab 70—that is, a vertical projection of the sides of tab body 74 does not significantly encompass any part of button 50, 150. Accordingly, if tab 70 is depressed while tab 70 is in its rest state, the tab does not depress button 50, thereby preventing inadvertent rupture of vent score 42 during handing and shipping of the unseamed ends and of the filled and seamed can.

To open the beverage container, a user grasps and lifts up heel 76 with a finger. In response to lifting heel 76, tab 70 deforms about hinge 80 (best shown in FIG. 4) such that tab nose 72 contacts main tear panel 28. The user continues to lift heel 76 until main score 26 ruptures to form the main pour opening. Preferably, the process for opening the main pour opening is conventional.

A user then pushes heel 76 down such that tab 70 is near its original position. Tab 70 may then be pivoted about rivet 22 until tab bead 82 is aligned with vent button 50, as shown in FIG. 6. Preferably, bead 82 contacts button 50 at a location that is offset from a center of the button in a direction toward proximal point 57 (in the first embodiment), which in turn preferably is positioned on the opposing side of button 50 from vent hinge 46.

Figure 13A:
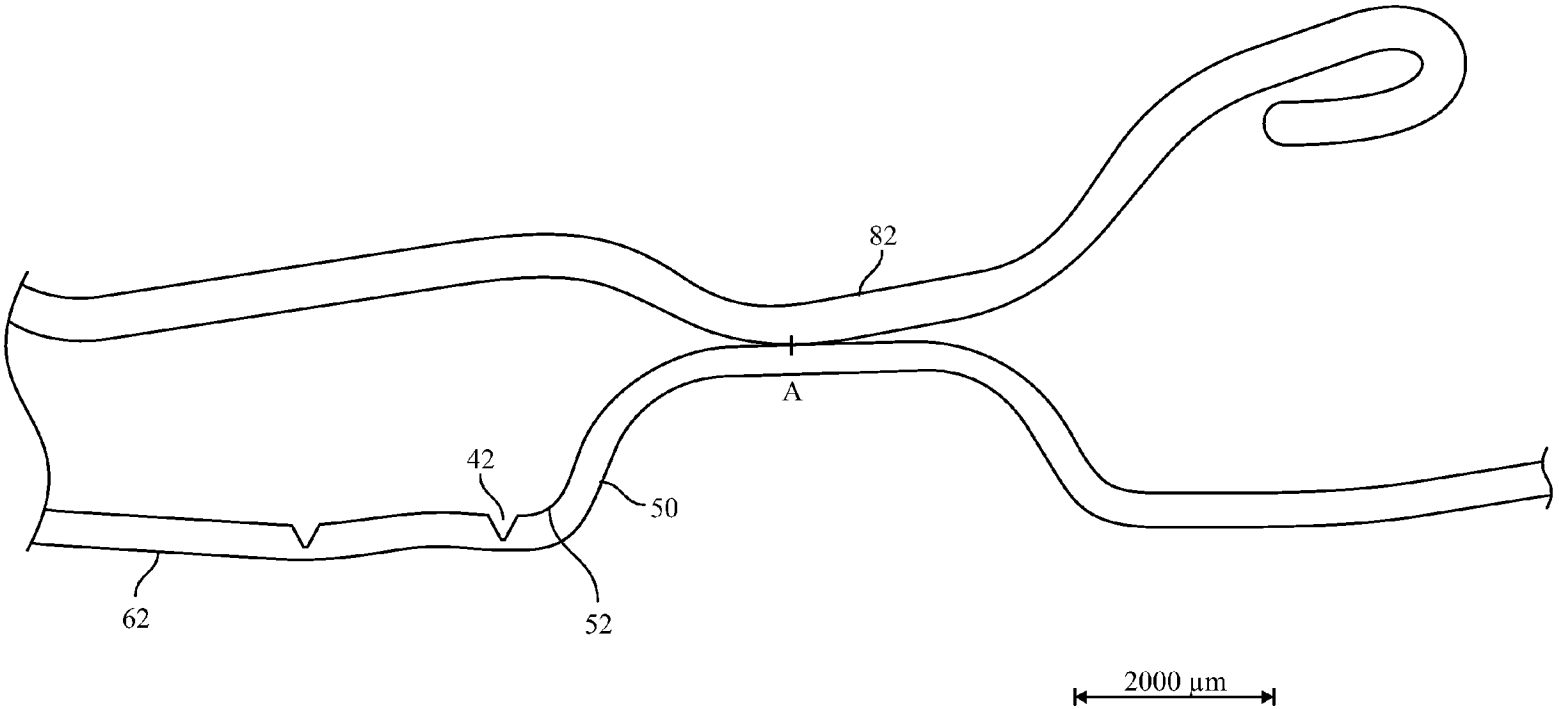
FIG. 13A is an enlarged, cross sectional view of a portion of the tab and vent according to a first embodiment can end with the tab rotated over the vent before downward actuation of the tab.
Figure 13B:
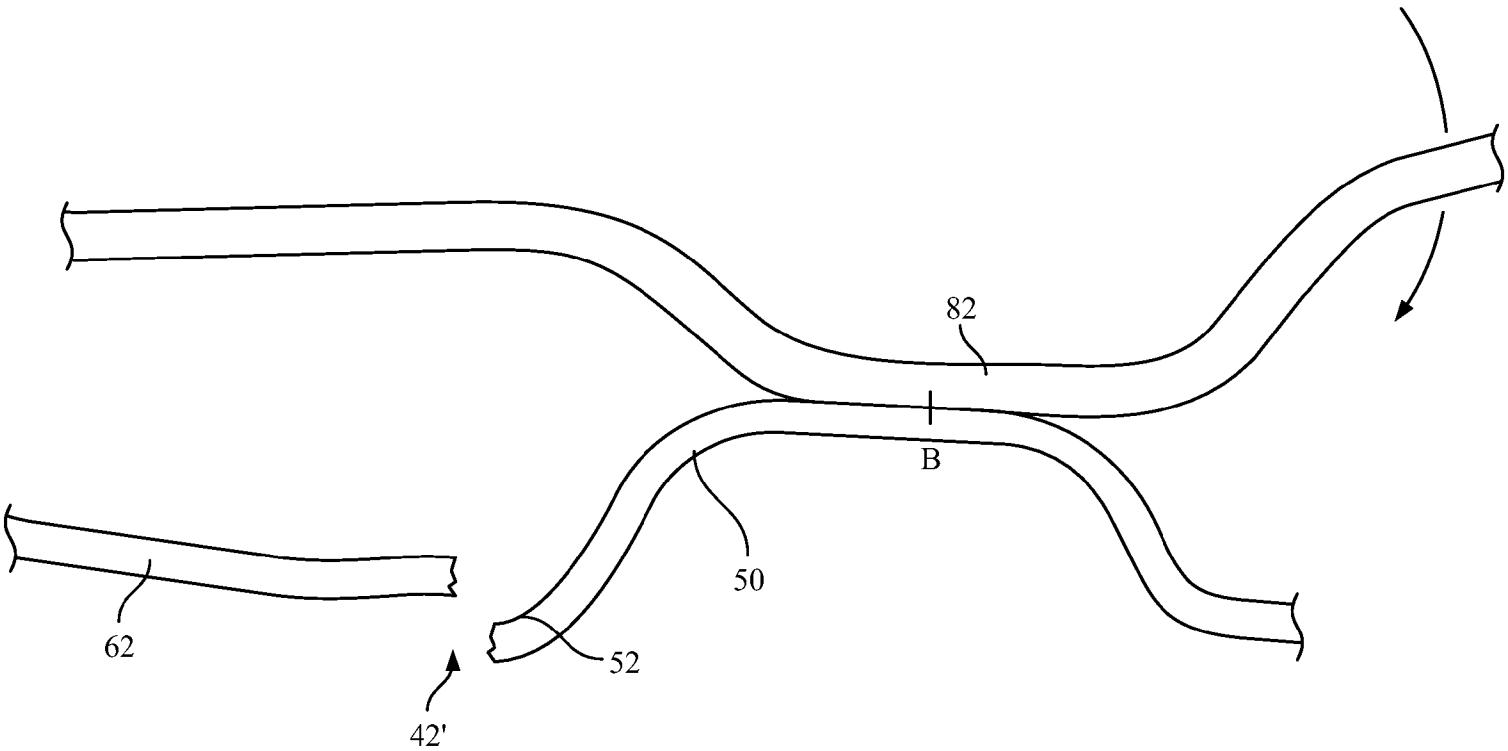
FIG. 13B is a cross sectional view of the embodiment of FIG. 13A showing the tab deflected downwardly and vent score ruptured.
Figure 13C:
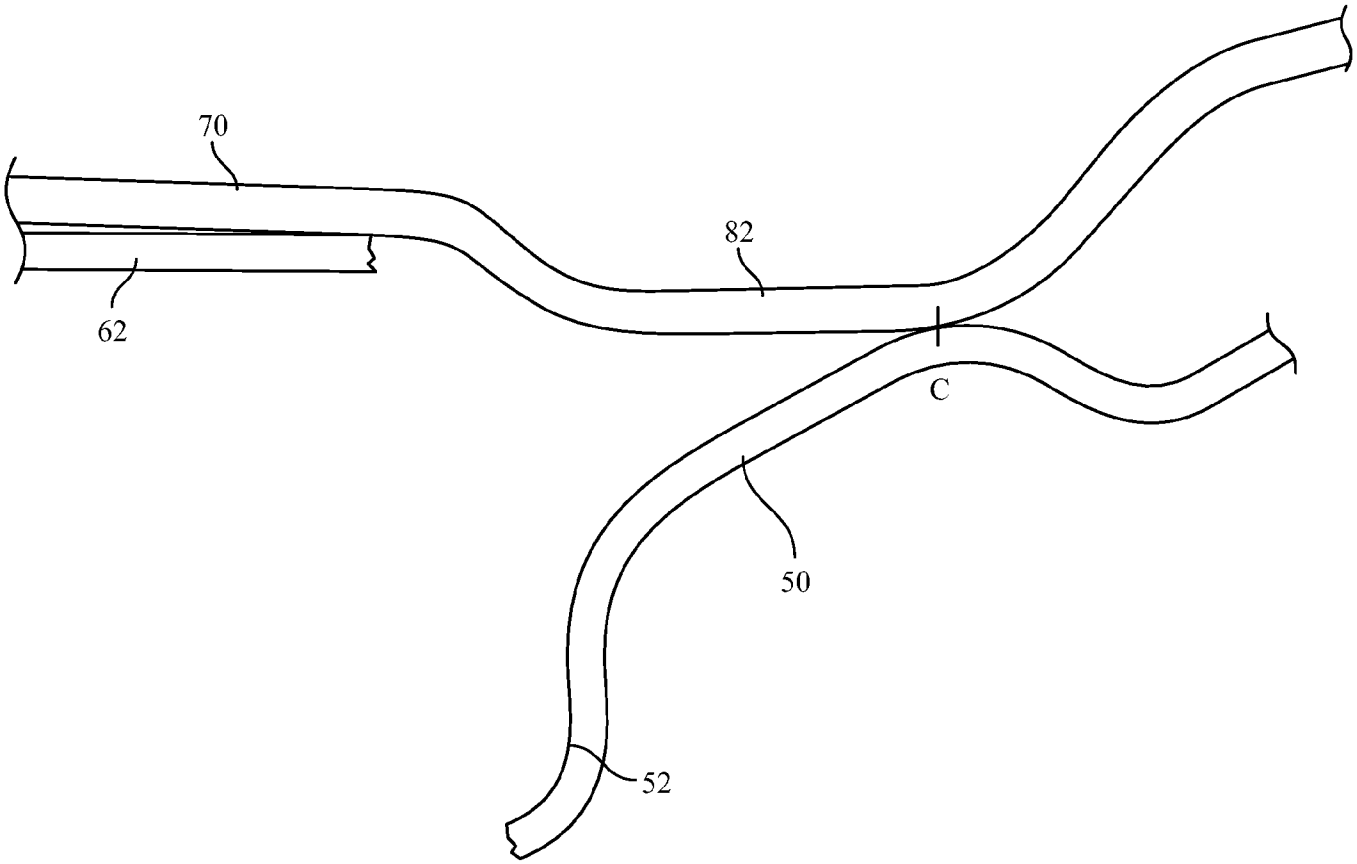
FIG. 13C is a cross sectional view of the embodiment of FIG. 13A showing the tab in its fully actuated position and the vent tear panel fully open.

As illustrated in FIG. 13A, bead 82 contacts button 50 first at a point A that is oriented relative to proximal point 57 as described above. As downward force is applied by the user by pushing downwardly on tab 70, vent score 42 ruptures initially, as shown in FIG. 13B near point 57. The orientation of proximal point 57 (for the first embodiment) and initial contact point A, and the geometry of button 50 and vent score 42, promote efficient and reliable opening. The elongated shape of vent tear panel 44 provides enhanced venting area (that is, the area of opening between the lip of vent tear panel 44 relative to deboss panel 62 that is not deflected upon rupture of vent score 42) compared with a circular score shape. After initial rupture, vent tear panel 44 pivots about hinge 46 such that subsequent downward movement of bead 82 changes the contact point from initial point A rearward (as oriented along the tab centerline) to contact point B and eventually more rearward to contact point C, which is shown in FIG. 13C. In other, the point of contact between the tab and button moves rearward as the present embodiment of the vent is actuated. The rolling or sliding of contact points A through C toward the vent hinge during the opening process enhances the angular deflection of vent tear panel 44, which is beneficial to the opening area. In embodiments in which bead 82 is sized to enter into the vent opening, the magnitude of the vent opening (as manifested by greater angular deflection about the hinge enabled by the bead entering into the opening) is enhanced for better venting performance.

After rupture of vent score 42 near proximal point 57, the rupture propagates in two directions about button 50 until reaching the opposing ends of vent score 42 as vent tear panel 44 is downwardly deflected.

In second embodiment vent 140, contact point A is not in line with the proximal point 157, but rather is at 90 degrees from it about the button circumference. After initial rupture, contact points A through C (not shown in the figures) more, by rolling or sliding, rearward (away from the rivet) or toward the vent hinge as generally described above. Vent score 142 likely first ruptures near one of the proximal points 157. The rupture propagates in two directions until reaching the opposing ends of vent score 142 as vent tear panel 144 is downwardly deflected. Alternatively, if enough energy builds up in vent tear panel 144 before initial rupture, score 142 may rupture initially at points that are 90 degrees from proximal points 157 or at several places simultaneously or virtually simultaneously.

The term "between" in the claims includes limits of the range. For example, if the claim recites between dimensions A and B, the claim encompasses the dimension being exactly A and exactly B, as well as equivalents and approximations.

Several features of a beverage can end and combination of can end and can body have been described. The present invention is not limited to any combination of the features described herein. Rather, the claims should be interpreted according to their full appropriate scope. The explanation of features relies on a person familiar with aluminum beverage can technology for understanding, such as technology for forming and seaming ends, forming recess, beads, and scores in ends, and the like.

What is claimed:

1. A beverage can end configured for containing a pressurized beverage, comprising:

a peripheral curl capable of being joined to a can body by seaming;

a wall structure radially inward from the curl;

a center panel;

a main score defining a main hinge and a main tear panel that is capable of opening upon rupture of the score to form a pour opening;

a tab coupled to the center panel by a rivet, the tab having a nose capable of contacting a portion of the main tear panel for rupturing the main score, a body, and a heel formed opposite the nose, the heel being configured for grasping by a user;

a vent including:

an elongated vent score defining a vent tear panel and a vent hinge located approximately between opposing ends of the vent score, the vent score is configured to be ruptured by a downward force applied to the tab; and an upwardly protruding button located on the vent tear panel, wherein the button is configured for contact by the underside of the tab heel, and the vent score, at a point at which the vent score is closest to a sidewall of the button, is located on the button or has a distance D3 or D13 from the button sidewall of no more than 0.020 inches such that downward force transmitted from the tab heel to the button ruptures the vent score; and a vent panel recess formed in the center panel, the vent tear panel being located in the vent panel recess;

wherein the center panel further comprises a main recess, each one of the main score, rivet, and vent panel recess being formed in the main recess, whereby actuation of the tab by lifting the heel is capable of rupturing the main score, actuation of the tab by pressing down on the tab is capable of rupturing the vent score, and the elongated vent score provides enhanced venting capacity upon deflection of the vent tear panel after rupture.

2. The beverage can end of claim 1 wherein a periphery of the vent panel recess is tangential to a periphery of the main recess.

3. The beverage can end of claim 1 wherein the vent button is located outboard of the tab while the tab is positioned to actuate the main score and the vent panel recess is located proximate a peripheral edge of the center panel distal from the rivet, whereby the vent is located to enhance venting.

4. The beverage can end of claim 1 wherein the tab includes an elongated bead on an underside of the tab proximate the heel, the tab and vent score being configured such that after actuation of the tab bead against the vent button, the tab bead is configured to enter into opening created upon rupture of the vent score to enhance deflection of the vent tear panel about the vent hinge.

5. The beverage can end of claim 1 wherein the vent hinge is parallel to the long axis of the elongated vent score.

6. The beverage can end of claim 1 wherein the vent hinge is perpendicular to the long axis of the elongated vent score.

7. The beverage can end of claim 1 wherein:

the vent score is disposed outboard of the button sidewall, and the distance D3 or D13, measured at a point at which the vent score is closest to the button sidewall, is less than 0.020 inches from the button sidewall;

the vent score is disposed on the button sidewall; or the vent score is disposed inboard of the button sidewall, such that a midpoint of a first line or a curve defined by a portion of the vent score disposed inboard of the button sidewall is no more than 0.010 inches from the button sidewall as measured along a second line that is perpendicular to the first line or perpendicular to the tangent of the curve at the midpoint, respectively.

8. The beverage can end of claim 1 wherein:

the vent score is disposed outboard of the button sidewall and the distance D3 or D13, measured at a point at which the vent score is closest to the button sidewall, is less than 0.015 inches from the button sidewall;

the vent score is disposed on the button sidewall; or the vent score is disposed inboard of the button sidewall, such that a midpoint of a first line or a curve defined by a portion of the vent score disposed inboard of the button sidewall is no more than 0.006 inches from the button sidewall as measured along a second line that is perpendicular to the first line or perpendicular to the tangent of the curve at the midpoint, respectively.

9. The beverage can end of claim 1 wherein the distance D3 or D13 from the vent score to the button sidewall is between approximately −0.000 inches and 0.006 inches.

10. The beverage can end of claim 1, wherein the vent tear panel defines:

a dimension X measured from a button center to lateral ends of the vent score along a vent centerline CL, a dimension Y measured from the button center to the vent hinge, and a dimension Z measured from the button center to a proximal point of the vent score, said proximal point being the point on the vent score that is closest to the button, and dimension X is greater than Z and less than 5Z and dimension Y is greater than 0.5Z and less than 3Z.

11. The beverage can end of claim 10 wherein dimension X is greater than 1.2 Z and less than 3Z, and dimension Y is greater than 0.75Z and less than 2Z.

12. The beverage can end of claim 10 dimension Y is greater than 0.9Z and less than 1.5Z.

13. The beverage can end of claim 10 wherein the Z dimension is between 0.0625 and 0.090 inches.

14. The beverage can end of claim 13 wherein the Z dimension is between 0.065 and 0.0850 inches.

15. The beverage can end of claim 14 wherein the Z dimension is between 0.068 and 0.078 inches.

16. The beverage can end of claim 10 wherein dimension Z is between 0.5 and 0.81 of button diameter D1.

17. The beverage can end of claim 16 wherein dimension Z is between 0.55D1 and 0.7D1.

18. The beverage can end of claim 17 wherein dimension Z is approximately 0.6D1.

* * * * *